US006325616B1

(12) United States Patent
Chato

(10) Patent No.: US 6,325,616 B1
(45) Date of Patent: Dec. 4, 2001

(54) PULSATING COMBUSTION UNIT WITH INTERIOR HAVING CONSTANT CROSS-SECTION

(76) Inventor: John D. Chato, 1412 - 1450 Chestnut Street, Vancouver, British Columbia (CA), V6V 4K3

( * ) Notice: Subject to any disclaimer, the term of this patent is extended or adjusted under 35 U.S.C. 154(b) by 0 days.

(21) Appl. No.: 09/541,502

(22) Filed: Apr. 3, 2000

(51) Int. Cl.[7] ..... F23C 11/04

(52) U.S. Cl. ..... 431/1; 431/354; 60/39.76

(58) Field of Search ..... 431/1, 354, 353, 431/350; 239/99, 101; 60/39.76, 39.77; 137/624.13; 122/24

(56) References Cited

U.S. PATENT DOCUMENTS

| | | | | |
|---|---|---|---|---|
| 2,635,420 | | 4/1953 | Jonker | 60/35.6 |
| 2,748,753 | | 6/1956 | Sarrazin et al. | 122/24 |
| 3,119,436 | | 1/1964 | Rydberg | 158/4 |
| 3,169,570 | | 2/1965 | Haag et al. | 158/4 |
| 3,606,867 | | 9/1971 | Briffa . | |
| 3,738,290 | | 6/1973 | Belter | 110/28 R |
| 4,314,444 | | 2/1982 | Putnam et al. | 60/39.77 |
| 4,318,392 | | 3/1982 | Schreiber et al. | 126/110 R |
| 4,479,484 | | 10/1984 | Davis | 126/362 |
| 4,569,310 | | 2/1986 | Davis | 122/24 |
| 4,637,792 | | 1/1987 | Davis . | |
| 4,639,208 | | 1/1987 | Inui et al. | 431/1 |
| 4,640,674 | * | 2/1987 | Kitchen | 431/1 |
| 4,708,634 | | 11/1987 | Vergne | 431/1 |
| 4,750,452 | | 6/1988 | Trihey | 122/24 |
| 4,759,312 | | 7/1988 | Pletzer | 122/24 |
| 4,780,076 | * | 10/1988 | Davis | 431/1 |
| 4,846,149 | | 7/1989 | Chato | 126/360 R |
| 4,959,009 | * | 9/1990 | Hemsath | 431/1 |
| 5,044,930 | | 9/1991 | Hongo et al. | 431/1 |
| 5,090,891 | * | 2/1992 | Hemsath | 431/1 |
| 5,168,835 | * | 12/1992 | Last | 122/24 |
| 5,242,294 | | 9/1993 | Chato | 431/1 |
| 5,454,711 | * | 10/1995 | Willems | 431/1 |

FOREIGN PATENT DOCUMENTS

| | | | | |
|---|---|---|---|---|
| 1050881 | | 1/1954 | (FR) | 6/4 |
| 58200910 | | 11/1983 | (JP) | 23/11 |
| 5-231615-A | * | 9/1993 | (JP) | 431/1 |
| 11-294714-A | * | 10/1999 | (JP) . | |
| 877227 | | 11/1981 | (SU) | 23/11 |
| 9100210 | | 6/1991 | (WO) . | |
| WO 93/15358 | | 8/1993 | (WO) . | |

* cited by examiner

*Primary Examiner*—Ira S. Lazarus
*Assistant Examiner*—Josiah C. Cocks

(57) ABSTRACT

A pulsating combustion unit includes an elongate combustion chamber having an interior cross-section, an intake end and an exhaust end and sides which are parallel from the intake end to the exhaust end. There is an intake portion adjacent to the intake end and an exhaust portion adjacent to the exhaust end. Preferably the combustion chamber has a generally equal cross-section between the intake end and the exhaust end. The combustion chamber may have an intake bulkhead adjacent to the intake end. The intake portion includes a slot in the bulkhead. The intake portion may also include a pair of spaced-apart plates extending outwardly from the slots in the bulkhead. Preferably these plates are spaced-apart closer together than the combustion chamber. The exhaust portion may include an exhaust bulkhead having an opening therein.

11 Claims, 5 Drawing Sheets

PULSATING COMBUSTION UNIT WITH INTERIOR HAVING CONSTANT CROSS-SECTION

BACKGROUND OF THE INVENTION

This invention relates to combustion units and, in particular, to pulsating combustion units.

Pulsating combustion units are well known. One variety of pulse combustion units includes three geometrically-configured adjoining channels. There is an intake section, a combustion chamber and an exhaust channel or tail pipe. Fuel and air are injected through the intake channel into the combustion chamber where the mixture is ignited. The heat created by the combustion process generates a pressure wave which travels from the combustion chamber through the tail pipe, carrying with it various gases or effluents resulting from the combustion process.

As the effluent gases exit the tail pipe, and the exterior of the combustion chamber cools, a partial vacuum is created within the combustion chamber which, in turn, draws a new supply of air and fuel into the combustion chamber from the intake channel. This new fuel-air mixture is then compressed by the effluent returning or "pulsing back" from the tail pipe. The new mixture is ignited as a result of the pressure increase and the remaining heat within the combustion chamber, causing the entire process to repeat in a pulsing action.

Such units are described, for example, in my earlier U.S. Pat. Nos. 4,846,149 and 5,403,180.

One type of prior art unit includes space-apart plates. Typically the unit includes a restriction downstream of the intake end. In other words, the plates are spaced-apart closer together from the restriction to the exhaust end of the unit. A high heat transfer coefficient is realized from the pressure gain environment as the gases move through the narrowed channel and are compressed. However there is a limitation as to how much mass flow can be realized through the narrowed channel because of its decreased cross-section. This accordingly restricts the output of the unit. The unit could be upscale do a larger output by extending the length or by placing multiple units side by side. However, this may not be feasible due to space limitations.

Another problem with some prior art units has been a relatively high $NO_x$ in the exhaust. This has limited acceptance of such units due to environmental considerations.

Accordingly, it is an object of the invention to provide an improved pulsating combustion unit which overcomes disadvantages associated with the prior art.

More specifically, it is an object of the invention to provide an improved pulsating combustion unit which has a higher heat output compared to prior art units of equivalent size.

It is also an object of the invention to provide an improved pulsating combustion unit which is simpler and less expensive to fabricate compared to prior art units.

It is a still further object of the invention to provide an improved pulsating combustion unit which has lower $NO_x$ emissions compared to prior art units.

SUMMARY OF THE INVENTION

In accordance with these objects, there is provided a pulsating combustion unit with an elongate combustion chamber having an interior cross-section, an intake end, an exhaust end and sides which are parallel from the intake end to the exhaust end. There is intake means adjacent to the intake end and an exhaust outlet adjacent to the exhaust end.

Preferably the combustion chamber has a generally equal cross-section between the intake end and the exhaust end thereof.

In one example the combustion chamber has a front plate, a rear plate and side plates, the front and rear plates being parallel and the side plates being parallel. The cross-section is then rectangular.

There may an exhaust bulkhead at the exhaust head of the combustion chamber. The exhaust outlet is an opening in the exhaust bulkhead.

There may be an intake bulkhead adjacent to the intake end. The intake means then includes a slot in the bulkhead. The intake means may also include a pair of spaced-apart plates extending outwardly from the slot in the bulkhead.

Where the combustion chamber has a front plate and a back plate parallel to the front plate, the plates of the intake means are parallel to each other and parallel to the front plate and the back plate and are closer together than the front plate and the back plate.

The fuel supply means may include a spray bar spaced-apart from the outer ends of the plates of the intake means.

DETAILED DESCRIPTION OF THE PREFERRED EMBODIMENTS

Figure 1:
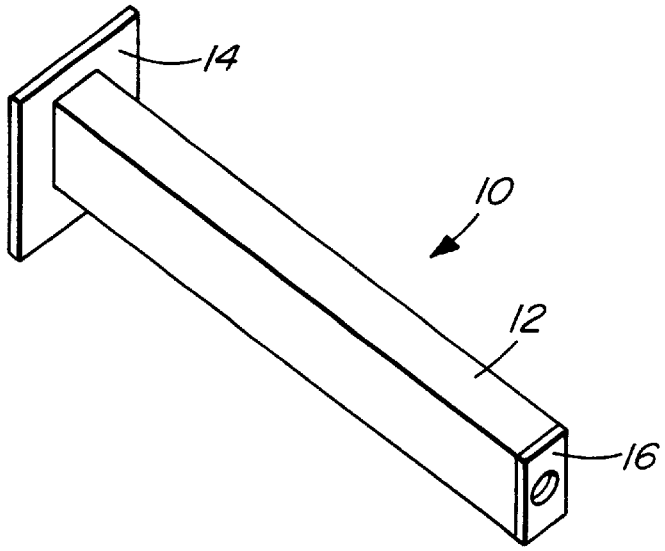
FIG. 1 is an isometric view of a pulsating combustion unit showing the exhaust end thereof.
Figure 2:
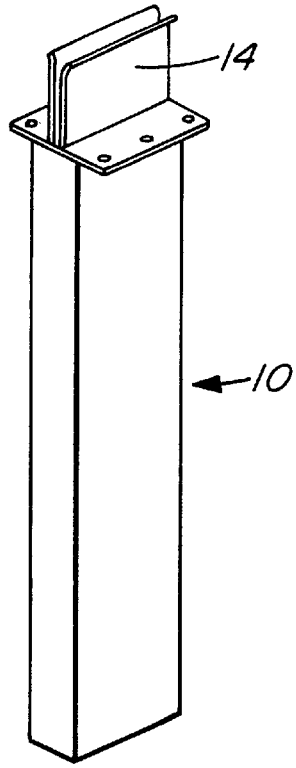
FIG. 2 is an isometric view thereof showing the intake end thereof.
Figure 3:
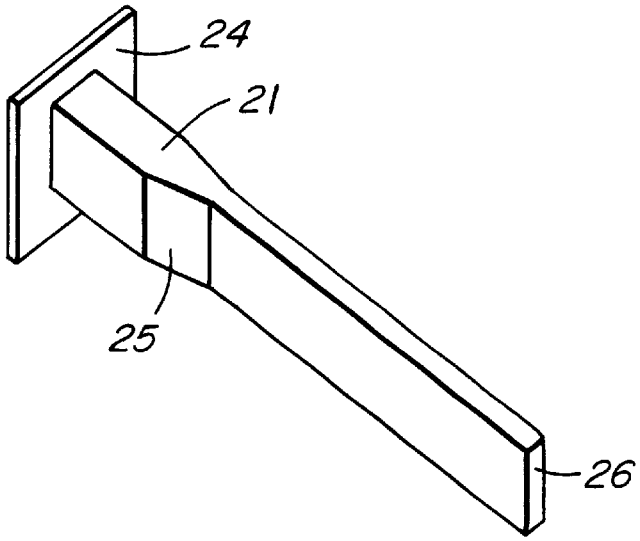
FIG. 3 PRIOR ART
FIG. 3 is an isometric view similar to FIG. 1, showing a pulsating combustion unit according to the prior art.

Referring to the drawings, and first to FIGS. 1 and 2, these show a pulsating combustion unit 10 according to an embodiment of the invention. The unit includes a combustion chamber 12, an intake portion 14 and an exhaust portion 16. These may be compared with a prior art unit as shown in FIG. 3. In this example the unit includes a body 21 which is relatively wide adjacent to the intake portion 24 but which narrows significantly at restriction 25 towards exhaust opening 26. As explained above, this restriction in the interior cross-section significantly reduces the throughput of hot gases and accordingly the thermal output of the unit. By comparison, as may be seen in FIGS. 1 and 2, combustion unit 10 has a cross-section which is constant from the intake portion 14 to the exhaust portion 16.

Figure 4:
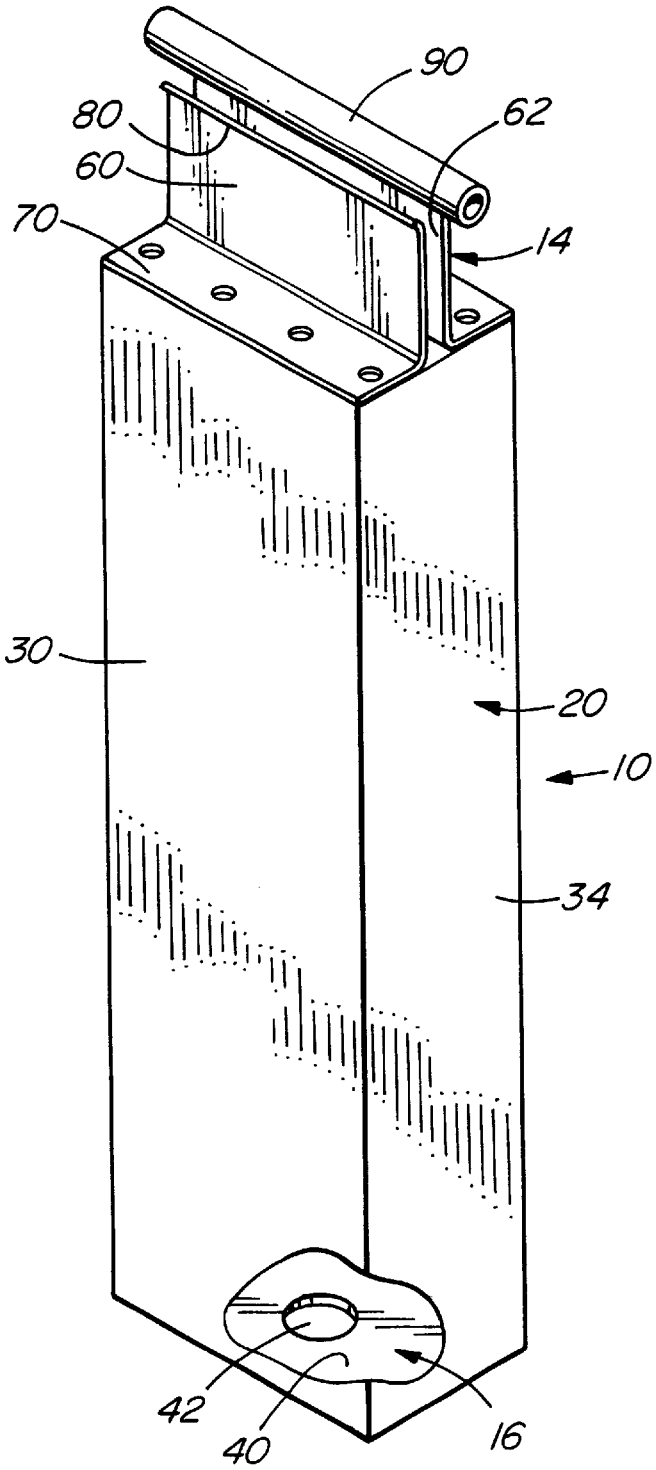
FIG. 4 is an enlarged, isometric view of the pulsating combustion unit of FIG. 2 showing the intake spray bar thereof and being partly broken away to show the exhaust opening thereof.
Figure 6:
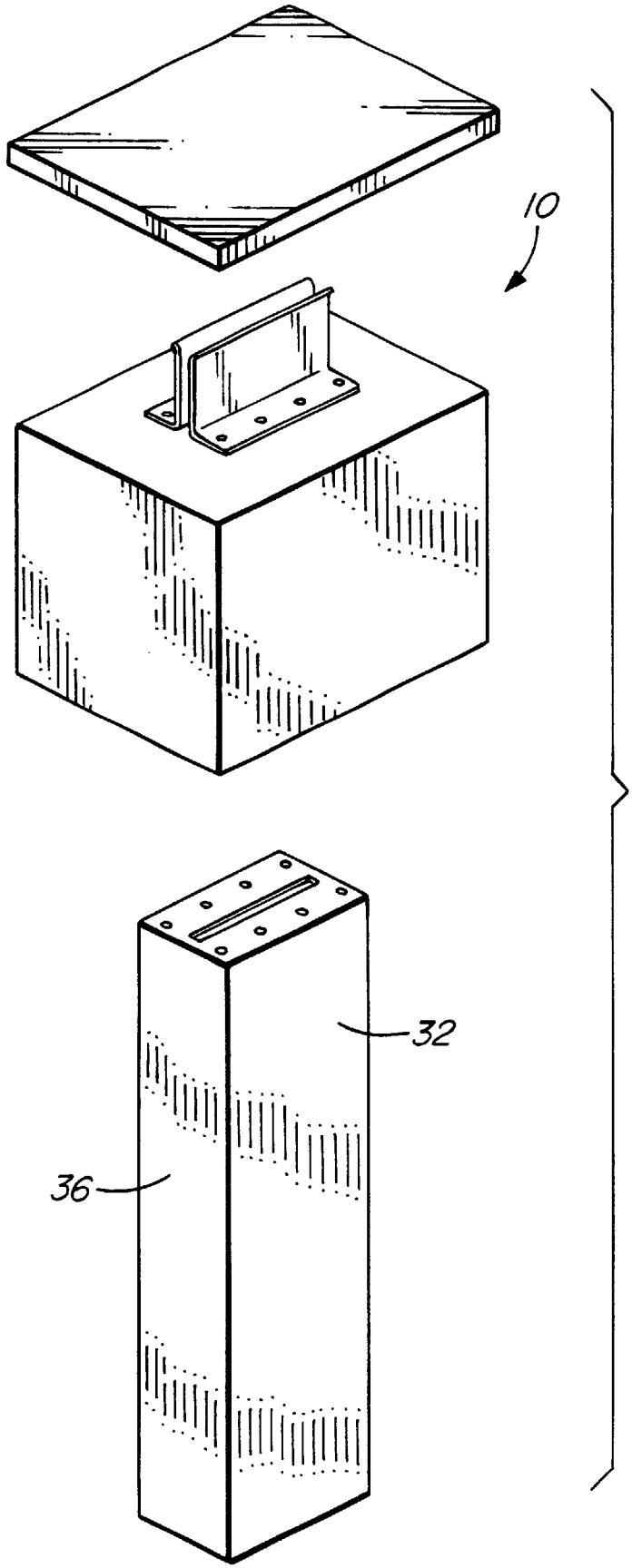
FIG. 6 is a exploded isometric view thereof.

Referring to FIGS. 4 and 6, the combustion chamber 20 has a front plate 30, a rear plate 32, which is parallel to the front plate, and side plates 34 and 36, which are parallel to each other and perpendicular to the front plate and rear plate. The terms "front", "rear" and "side" are somewhat arbitrary and are used primarily for clarity of the explanation of the unit. It may be appreciated therefore that the interior of the combustion chamber is rectangular in shape and has a constant cross-section between intake portion 14 and exhaust portion 16. However it should be understood that the cross-section does not have to be completely constant, it may taper slightly for example. However it does not have the marked restriction 25 found in the prior art of FIG. 3. It should also be understood that, while the combustion chamber is rectangular in section, it could be other shapes including, for example, a circular cross-section, a triangular cross-section, an oval cross-section, or other polygonal shapes or irregular shapes. In the illustrated embodiment, the front plate, rear plate and side plates are flat.

The exhaust section 16 includes an exhaust bulkhead 40 which is connected to the front plate, the rear plate and the side plates adjacent to exhaust portion 16. In this example the bulkhead is rectangular in section and equivalent in size and shape to the interior of the combustion chamber. It has an opening 42 which is considerably smaller in size than the interior of the combustion chamber. In this example the opening 42 is shown as a circular opening, although it could be other shapes including, for example, a rectangular opening or a slot. The exhaust opening serves a similar purpose to the restriction 25 in FIG. 3, but is moved considerably downstream from the location thereof.

Figure 7:
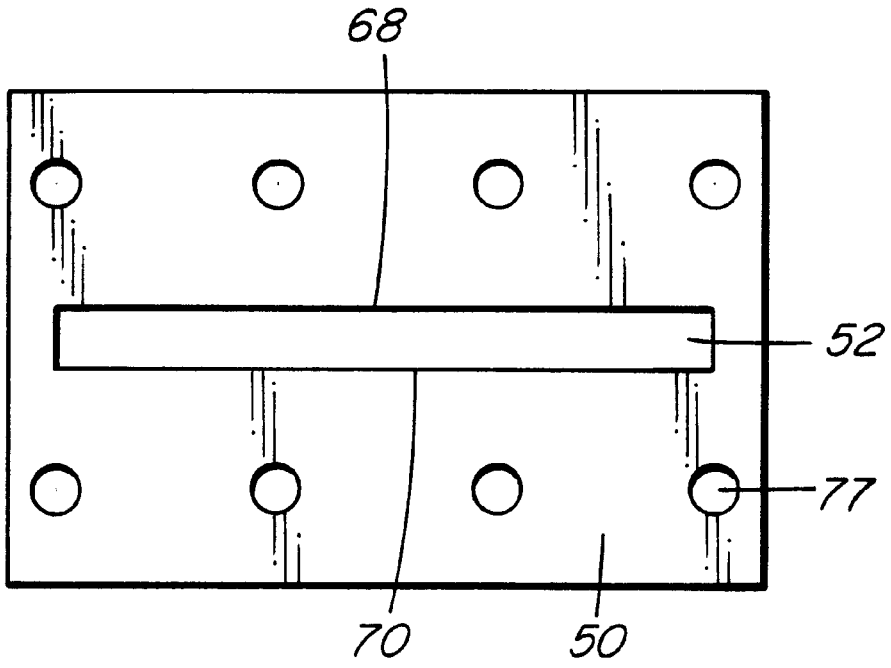
FIG. 7 is a top plan view of the intake bulkhead thereof.
Figure 8:
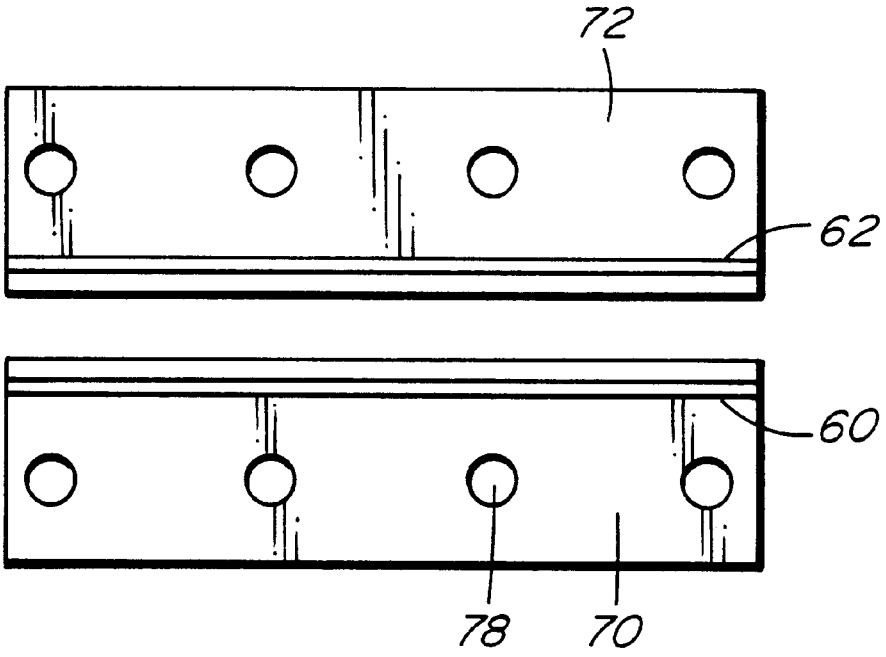
FIG. 8 is a top plant view of the intake plates thereof.

Intake portion 14 includes an intake bulkhead 50, shown best in FIG. 7, which includes a slot 52 therein.

The intake means also includes a pair of spaced-apart plates 60 and 62 which, in this example, extend parallel to the front plate 30 and rear plate 32 of the combustion chamber. There are located on opposite sides of slot 52 and, in this example, are spaced-apart a distance equal to the width of the slot 52. The width is defined as the distance across the slot between sides 68 and 70 shown in FIG. 7. The plates are each L-shaped in this example, having bases 70 and 72 respectively. The bulkhead 50 has a plurality of mounting holes 77 which align with mounting hole 78 in the plates 60 and 62. A plurality of nuts and bolts or other fasteners are utilized to connect the plates to the bulkhead.

Figure 5:
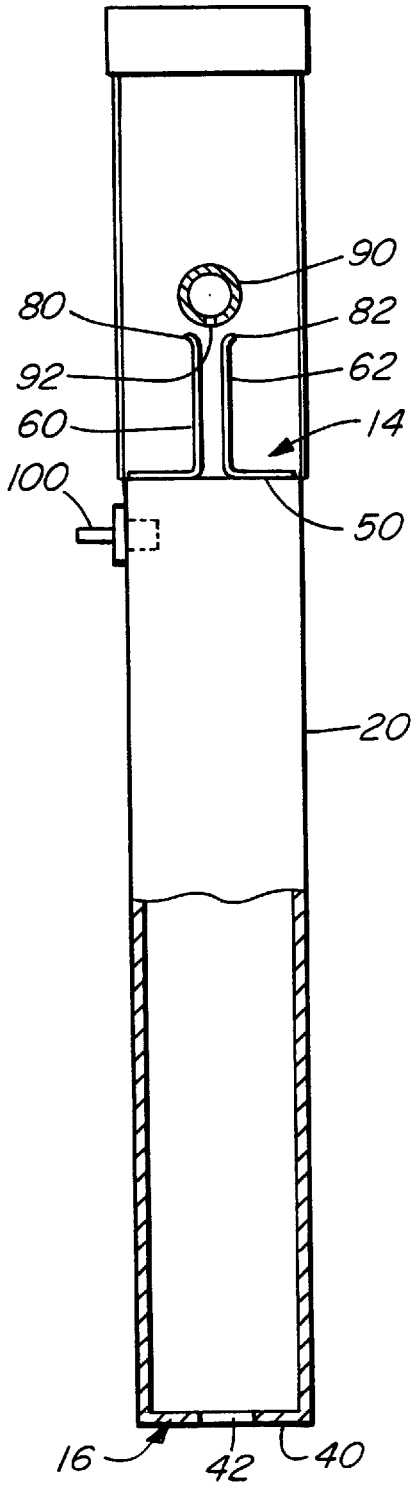
FIG. 5 is a side elevation thereof, partly broken away.

As best shown in FIG. 5, outer ends 80 and 82 of the plates 60 and 62 are splayed. In other words, they curve outwardly away from each other.

There is spray bar 90 extending along outer ends 80 and 82 of the plates 60 and 62 and spaced-apart therefrom. The spray bar has a plurality of openings 92 therein, whereby fuel from the spray bar is sprayed between the plates 60 and 62. The fuel can be a gaseous fuel or a liquid fuel. The spray bar may be other shapes such as a rectangular shape. In one embodiment, where the fuel is natural gas, the openings are 0.031". There are such openings in a 4" spray bar in this example.

Igniter 100 is shown in FIG. 5 by way of example. It can be for example a spark plug. Alternatively the mixture can be ignited simply by a spark or a small flame placed adjacent to the spray bar.

The operation of the device is similar to previous pulsating combustors and accordingly is described only briefly. The fuel and air mixture is drawn into the combustion chamber 20 between the plates 60 and 62 and through the slot 52 of the intake bulkhead. It is ignited within the combustion chamber and passes through the combustion chamber to the exhaust portion 16 of the unit where it exits through the opening 42. A pulsating action is accomplished which periodically draws a fresh fuel and air mixture into the combustion chamber through slot 52 where it is combusted and then pulsed outwardly through the exhaust opening 42 in bulkhead 40.

The thermal efficiency of the unit is substantially better than accomplished by prior art units such as that shown in FIG. 3. A considerably greater throughput of hot gases through the combustion chamber is accomplished by the constant area of the unit between the intake portion and exhaust portion thereof. Moreover, it has been found that the $NO_x$ emissions have been significantly reduced compared to the prior art.

Figure 9:
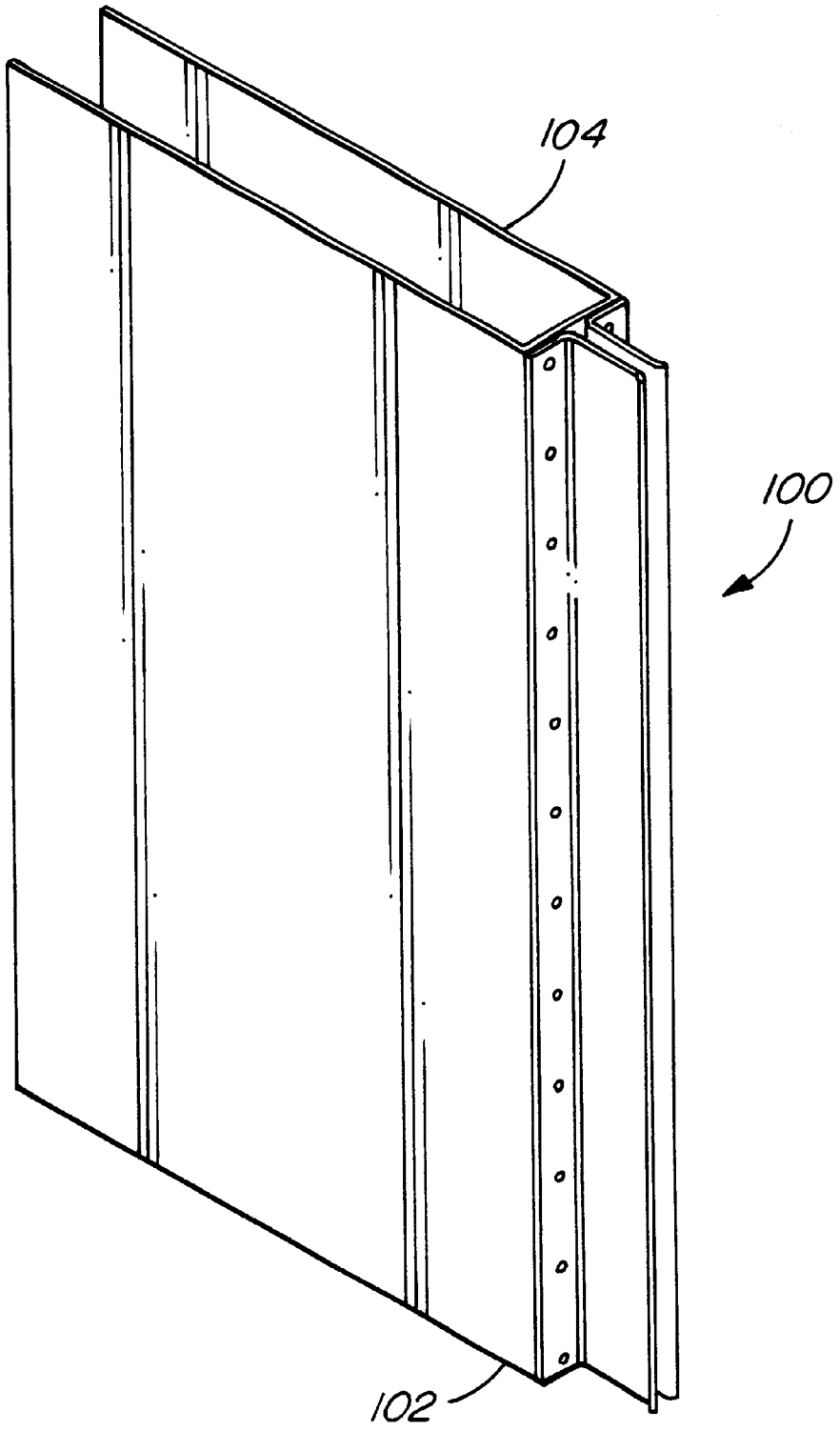
FIG. 9 is an isometric view of a variation thereof having a substantially greater width than the embodiment of FIGS. 4–8, one of the ends thereof being removed.

FIG. 9 shows a combustion unit 1000 which is similar to unit 10 above but represents the equivalent of a plurality of such units placed side to side. The unit is considerably wider between ends 102 and 104 thereof compared to unit 10. Otherwise the structure is similar. The ends are closed with plates, but the plate at end 104 is removed for illustrative purposes.

It will be understood by someone skilled in the art that many of the details provided above are by way of example only and are not intended to limit the scope of the invention which is to be interpreted with reference to the following claims:

What is claimed is:

1. A pulsating combustion unit, comprising:

an elongate combustion chamber having an interior cross-section, an intake end, an exhaust end, sides which are parallel from the intake end to the exhaust end and an intake bulkhead adjacent the intake end;

intake means adjacent to the intake end including a slot in the bulkhead, the slot having a width, and a pair of spaced-apart plates extending outwardly from the slot in the bulkhead; and an exhaust outlet adjacent to the exhaust end.

2. The pulsating combustion unit of claim 1, wherein the unit has a generally constant interior cross-section between the intake end and the exhaust end thereof.

3. The pulsating combustion unit of claim 2, wherein the combustion chamber has a front plate, a rear plate and side plates, the front and rear plates being parallel and the side plates being parallel, the cross-section being rectangular.

4. The pulsating combustion unit of claim 3, wherein the plates are flat.

5. The pulsating combustion unit of claim 1, having an exhaust bulkhead at the exhaust end of the combustion chamber, the exhaust outlet being an opening in the bulkhead.

6. The pulsating combustion unit of claim 5, wherein the opening in the bulkhead is smaller than the interior cross-section of the combustion chamber.

7. The pulsating combustion unit of claim 1, wherein the combustion chamber has a front plate and a back plate parallel to the front plate, the plates of the intake means being parallel to each other and parallel to the front plate and the back plate and being closer together than the front plate and the back plate of the combustion chamber.

8. The pulsating combustion unit of claim 7, wherein the plates of the intake means are spaced-apart a distance equal to the width of the slot.

9. The pulsating combustion unit of claim 8, wherein the plates of the intake means have outer ends which are distal to the combustion chamber, the intake means including a fuel supply means adjacent to the outer ends.

10. The pulsating combustion unit of claim 9, wherein the fuel supply means includes a spray bar spaced-apart from the outer ends of the plates of the intake means.

11. The pulsating combustion unit of claim 9, wherein the plates of the intake means have splayed outer ends.

* * * * *